United States Patent [19]

Schäfer et al.

[11] Patent Number: 4,492,087

[45] Date of Patent: Jan. 8, 1985

[54] CONTAINER FOR STORING REFRIGERATED LIQUIDS

[75] Inventors: Hans Schäfer, Darmstadt; Michael Gaschler, Reinbeck, both of Fed. Rep. of Germany

[73] Assignees: Philipp Holzmann AG, Frankfurt; Gg. Noell GmbH, Würzburg, both of Fed. Rep. of Germany

[21] Appl. No.: 503,693

[22] Filed: Jun. 13, 1983

[30] Foreign Application Priority Data

Jun. 11, 1982 [DE] Fed. Rep. of Germany ..... 3222064

[51] Int. Cl.[3] ..... F17C 1/00

[52] U.S. Cl. ..... 62/45; 220/445; 220/901

[58] Field of Search ..... 62/45; 220/437, 439, 220/445, 900, 901

[56] References Cited

U.S. PATENT DOCUMENTS

| | | | |
|---|---|---|---|
| 3,339,784 | 9/1967 | Filstead, Jr. | 220/901 |
| 3,362,559 | 1/1968 | Kohring | 220/901 |
| 3,688,938 | 9/1972 | Yamamoto et al. | 62/45 |
| 3,754,675 | 8/1973 | Richard et al. | 220/901 |
| 3,852,973 | 12/1974 | Marothy | 62/45 |
| 3,930,375 | 1/1976 | Hofmann | 220/901 |
| 4,041,722 | 8/1977 | Terlesky et al. | 62/45 |

*Primary Examiner*—Ronald C. Capossela

*Attorney, Agent, or Firm*—Horst M. Kasper

[57] ABSTRACT

A container is disclosed for storing refrigerated liquids, in particular for liquefied gases, which comprises a steel reinforced concrete outer container and a steel inner container inserted into the outer container, where the steel inner container rests on an insulation and where an annular interspace is present between the outer circumference of the inner steel container and the inner circumference of the outer container. The interspace can be fully or in part of its thickness filled with insulating materials. In order to prevent the liquid pouring in a gush into the interspace and causing locally high loads acting on the steel reinforced concrete container upon a cracking of the steel inner container, several gush braking bodies protruding into the interspace are disposed at the inner circumference of the outer container and/or at the outer circumference of the inner steel container, which bodies extend in radial direction about one third of the width of the interspace, and which preferably reach only to about two thirds of the total height of the interspace and which according to a preferred embodiment are provided with a triangular cross-section.

19 Claims, 3 Drawing Figures

CONTAINER FOR STORING REFRIGERATED LIQUIDS

BACKGROUND OF THE INVENTION

1. Field of the Invention

The invention relates to a container for storage of refrigerated liquids, in particular for liquefied gases, which comprises a reinforced concrete or prestressed concrete outer container and a steel inner container placed into the outside container.

2. Brief Description of the Background of the Invention Including Prior Art

The use of gas as an energy carrier in private and industrial spheres has increased in recent times. In addition to the transport of the gas from remote production places to the user, the gas is also transported by ship after liquefaction. The liquefied gas then also requires corresponding stationary storage provisions, where the prescribed safety provisions have to be met.

The formation of an inner and outer container depends on what kind of safety provisions have to be met in order to prevent in extraordinary cases transmission of effects from the outside to the inside or in case of a leak to prevent the exit of gas from the inside to the outside.

Frequently, an open steel inner container disposed in a steel reinforced concrete or prestressed concrete container closed at all sides is required for the storage of liquefied natural gas (LNG). Liquid ammonia, butane, and ethane are frequently stored in closed steel containers, which are positioned in steel reinforced concrete or prestressed concrete containers open at the top.

The insulation depends on the kind of the gas. In case of the storage of liquefied natural gas, which has to be stored at a temperature of about −160 degrees centigrade, the interspace is completely filled with insulating material. Since the intermediate space not only serves for the placement of insulation, but also has to be present in case of disturbances or required repair works, usually expanded Perlite is employed as insulating material. The starting material for the expanded perlite is volcanic silicate containing rock, where upon short term heating to about 1000 degrees centigrade the bound water is transformed into vapor such that the glass melt is popped to a multiple of its original volume. If required, the perlite can be removed from the interspace.

If liquefied butane gas is to be stored in the container then a complete filling of the interspace with insulating material is not required, since the storage temperature for liquid butane gas is only at about −10 degrees centigrade and therefor a thin insulating layer, for example from polyurethane, on the outer circumference of the inner container is sufficient.

Substantial safety provisions have to be arranged in order to operate such a container. On the one hand, the outer container has to be stable against earthquakes, but on the other hand also the loads arising from a cloud of gas explosion have to be supported. Also, the load case where the inner container suddenly rips open has to be provided for. Since steel tends to be brittle at low temperatures, defects in the steel material can in fact, result in the situation where an initially small breakage area expands to a continuous fracture. The result is that the refrigerated liquid pours out of the crack and pours into the intermediate space between the steel inner container and the steel reinforced concrete outer container and flows from the exit location in two directions into the intermediate space.

Considering initially the simplified case where no insulating material is disposed in the interspace, then the flow of liquid runs into two directions within the interspace until the two partial streams meet at the side approximately diametrical to the breakage point. Model experiments have demostrated that then at this position a pressure is exerted onto the steel reinforced concrete, which locally reaches up to the sixfold hydrostatic pressure such that thereby the steel reinforced concrete containers are impermissibly loaded.

Such a liquid flow can also then occur if the intermediate space between the inner and the outer container is filled with sufficiently permeable and/or displaceable material such as for example expanded perlite.

At any rate, a bursting or rupturing of the steel inner container would result in case of the known containers in having the liquid gas pour in a gush into the intermediate space and either displace the light weight perlite material or run along the free space of the annular slot, such that the encounter of the pouring out liquid gas at the side disposed diametrically opposite results in an impermissible loading of the steel reinforced concrete outer container.

SUMMARY OF THE INVENTION

1. Purposes of the Invention

It is an object of the present invention to provide a container where such impermissible loads cannot occur.

It is another object of the present invention to brake the flow of liquid in the annular interspace area between two containers.

It is a further object of the present invention to prevent the complete rupturing of containers, if an inner steel container with liquid cracks.

These and other objects and advantages of the present invention will become evident from the description which follows.

2. Brief Description of the Invention

The present invention provides a container for storage of refrigerated liquids which comprises a concrete outer container, an insulation disposed on the bottom of the outer container, an inner steel container resting on the insulation and disposed inside the outer container for providing an annular interspace between the inner wall side of the outer container and the outer wall side of the inner container, insulating material filled into the interspace, and at least two gush braking bodies attached to either the outer wall side of the inner container or to the inner wall side of the outer container and protruding into the interspace.

The outer container can be constructed from steel reinforced concrete or from prestressed concrete. The gush braking bodies can extend in radial direction from about one quarter to one half of the width of the annular interspace between the two containers. The braking bodies can be provided as baffle plates or can be provided with a triangular cross-section. An uneven number of gush braking bodies can be uniformly distributed over the inner circumference of the inner container, and preferably five gush braking bodies are provided.

The gush breaking bodies can reach to about two thirds of the total height of the interspace. An insulating layer of an insulating material can be disposed at the outer circumference of the inner container. The insulating material can be a member of the group consisting of polyurethane, mineral wool, plastic foam, exploded minerals, perlite, exploded perlite and mixtures thereof. The edge protruding from the gush braking body into the interspace can be pointed at the end edge protruding into the interspace. The gush braking bodies can be provided with perforations.

There is also provided a safety method for insuring the stability of containers for refrigerated liquids which comprises providing an outside concrete container, placing insulation onto the bottom of the concrete container, setting a steel container onto the insulation in the concrete container concentric to the concrete container, and disposing baffle bodies for braking gushes of refrigerated liquid attached vertically at the walls of the containers and protruding into the interspace between the containers. Preferably, the baffle bodies protrude from about 0.25 to 0.5 of the width of the annular interspace in radial direction.

The novel features which are considered as characteristic for the invention are set forth in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWING

In the accompanying drawing, in which is shown one of the various possible embodiments of the present invention.

DESCRIPTION OF INVENTION AND PREFERRED EMBODIMENTS

Figure 1:
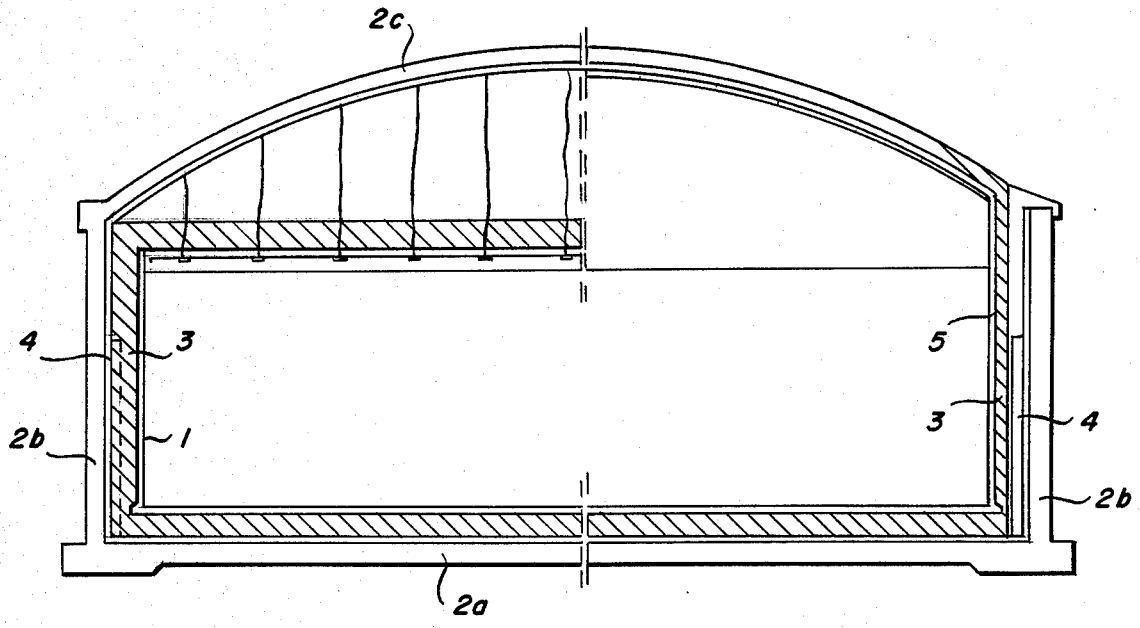
FIG. 1 is a view of a cross-sectional representation of a container for storing of liquefied gas, where on the left hand side of the FIG. 1 the interspace is completely filled with insulating material, while on the right hand side only the outer face of the inner container is furnished with an insulating layer.

In accordance wth the present invention there is provided a container for storage of refrigerated liquids, in particular of liquefied gases, which comprises a steel reinforced concrete or prestressed concrete outer container and a steel inner container for receiving the liquid and set into the outer container, where the steel inner container rests on an insulation and where an annular interspace is present between the outer surrounding surface of the steel container and the inner circumferential face of the outer container, which interspace is filled completely or only over part of its thickness with insulating materials, which is characterized in that several gush braking bodies 4 protruding into the interspace are disposed at the inner circumference of the outer container 2 and/or at the outer circumference of the inner steel container 1.

The gush braking bodies 4 can extend over about one third of the width of the interspace 3 in radial direction. The gush braking bodies can be provided as plates 4*b* or can be provided with a triangular cross-section 4*a*. An uneven number of and preferably 5 gush braking bodies 4 can be uniformly disposed on the inner circumference of the outer container 2. The gush braking bodies can extend to about only two thirds of the total height of the interspace 3. An insulating layer of polyurethane, mineral wool or the like can be provided at the outer circumference of the inner container or at the inner circumference of the outer container. The total interspace 3 can in a conventional way be filled with exploded perlite.

It is of essential importance that the gush braking bodies in the case of a crack of the steel inner container do not simply stop the flow of exiting refrigerated liquefied gas, since this could generate substantial and in part uncontrolled forces, but the gush braking bodies are to be provided such, that at the top of the profile protruding into the interspace the flow breaks away and transfers into a turbulence, such that thereby the energy is withdrawn from the gush, which energy would lead to difficulties at the side disposed diametrically opposite to the rupture location. These preconditions are met very well by a profile triangular in cross-section.

Referring now to FIG. 1 there is shown a steel reinforced concrete outer container, which comprises a floor plate 2*a*, a wall 2*b*, and, as seen on the left side, a roof dome 2*c*. An inner container 1 of steel is disposed in the outer container separated by an interspace 3, which inner container is in the right part open to the top and in the left part closed at the top, and which serves to receive liquefied gas. The wall thickness of the steel inner container 1 amounts to from about 14 to 30 millimeters, the thickness of the interspace 3 is about 1 meter, and the wall thickness of the steel reinforced concrete outer container is about 50 centimeters. The insulation under the bottom of the steel container comprises foamed cellular glass, which is adapted to support the static load of the container 1 filled with liquefied gas. The interspace between the two containers is filled with a granulate of perlite as shown in the left part of FIG. 1. The non-combustible granulate of perlite provides the advantage that it can be entered in a simple way into the interspace and that it can be just as easily removed for inspection purposes or for required repair work by suctioning it off.

Figure 3:
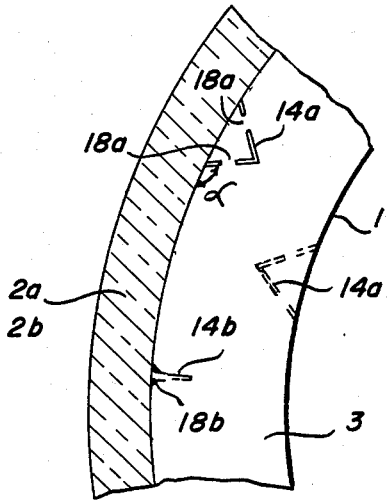
FIG. 3 is a detail view of a cross-section through the wall of the container according to a further embodiment.

Only a thin layer 5 of polyurethane is provided in the interspace 3 in the right hand side part of FIG. 3, which as shown is disposed at the outer circumference surface of the steel inner container.

Figure 2:
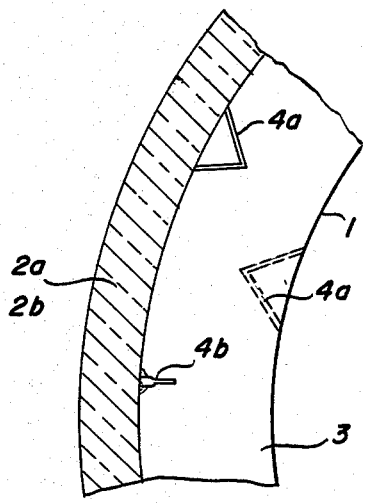
FIG. 2 is a detail view of a cross-section through the wall of the container.

In order to prevent that the partial streams exiting out of the container at a crack in case of a sudden rupture to the two sides encounter each other in a gush under displacement of the perlite granulate or, respectively, by passing of the polyurethane insulation, there are provided several gush baffle bodies 4 at the inner circumference, which are provided with a triangular cross-section with a tip directed inwardly as can be recognized from the cross-section of FIG. 2. The radial dimensions of the body 4 are selected such that they take up about one third of the width of the interspace 3. The height of the floor plate 2*a* amounts to about two thirds of the total height of the side wall 2*b*.

The embodiment of FIG. 3 is similar to that of FIG. 2 and like parts are designated with like numerals. However, the gush breaking baffles 14*a* and 14*b* of FIG. 3 are provided with performations 18*a* and 18*b*, respectively.

The gush braking bodies 4 preferably comprise sheet metal, where it is sufficient if five such bodies are disposed in uniform distribution over the total circumference. It is possible to provide more such bodies and it would also be possible to dispose these bodies only or additionally at the outer circumference of the steel inner container 1.

The stream of liquid flows along the side faces of the triangular bodies 4*a* upon rupturing of the liquid containing steel inner container. A turbulence occurs at the tip, which decreases the energy of the stream of liquid.

The exposed angle between the tank and the baffle bodies can be 90 degrees or greater, and the baffle bodies can extend in radial direction to from about one quarter to one half of the width of the annular interspace between the two containers. The exposed angle between tank and gush breaking bodies is shown in FIG. 3.

The side faces of the bodies 4*a* do not need to be exactly planar, they can also be rounded inwardly in order to support the formation of vortices.

The shape of the body 4 is not limited to a triangular cross-section. Other shapes are also conceivable, where however such shapes are to be preferred which run out into a tip. In the simplest case radially running plates 4*b* could be employed, which possibly could be provided with holes.

It will be understood that each of the elements described above, or two or more together, may also find a useful application in other types of system configurations and gas processing procedures differing from the types described above.

While the invention has been illustrated and described as embodied in the context of a storage tank for liquefied gases, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. Container for storage of refrigerated liquids comprising a concrete outer container;

an insulation disposed on the bottom of the outer container, an inner steel container resting on the insulation and disposed inside the outer container for providing an annular interspace between the inner wall side of the outer container and the outer wall side of the inner container;

insulating material filled into the interspace; and at least two gush braking bodies attached to either the outer wall side of the inner container and/or to the inner wall side of the outer container and protruding into the interspace, wherein the exposed angle between the tank and the gush breaking body is 90 degrees or greater, and wherein the gush braking bodies extend in radial direction to from about one quarter to one half of the width of the annular interspace between the two containers.

2. The container for storage of refrigerated liquids according to claim 1 wherein the outer container is constructed from steel reinforced concrete.

3. The container for storage of refrigerated liquids according to claim 1 wherein the outer container is constructed from prestressed concrete.

4. The container for storage of refrigerated liquids according to claim 1 wherein the gush braking bodies are provided as baffle plates.

5. The container for storage of refrigerated liquids according to claim 4 wherein an uneven number of gush braking bodies are uniformly distributed over the inner circumference of the outer container.

6. The container for storage of refrigerated liquids according to claim 5 where in total five gush braking bodies are provided.

7. The container for storage of refrigerated liquids according to claim 4 wherein the gush braking bodies reach up to about two thirds of the total height of the interspace.

8. The container for storage of refrigerated liquids according to claim 7 wherein an insulating layer of an insulating material is disposed at the outer circumference of the inner container.

9. The container for storage of refrigerated liquids according to claim 8 wherein the insulating material is a member of the group consisting of polyurethane, mineral wool, plastic foam, exploded minerals, perlite, exploded perlite and mixtures thereof.

10. The container for storage of refrigerated liquids according to claim 1 wherein the gush braking bodies are provided with a triangular cross-section.

11. The container for storage of refrigerated liquids according to claim 10 wherein an uneven number of gush braking bodies are uniformly distributed over the inner circumference of the outer container.

12. The container for storage of refrigerated liquids according to claim 11 where in total five gush braking bodies are provided.

13. The container for storage of refrigerated liquids according to claim 10 wherein the gush braking bodies reach up to about two thirds of the total height of the interspace.

14. The container for storage of refrigerated liquids according to claim 13 wherein an insulating layer of an insulating material is disposed at the outer circumference of the inner container.

15. The container for storage of refrigerated liquids according to claim 14 wherein the insulating material is a member of the group consisting of polyurethane, mineral wool, plastic foam, exploded minerals, perlite, exploded perlite and mixtures thereof.

16. The container for storage of refrigerated liquids according to claim 1 wherein the edge protruding from the gush braking body into the interspace is pointed at the end edge protruding into the interspace.

17. The container for storage of refrigerated liquids according to claim 1 wherein the gush braking bodies are provided with perforations.

18. A safety method for insuring the stability of containers for refrigerated liquids comprising providing an outside concrete container;

placing insulation onto the bottom of the concrete container;

setting a steel container onto the insulation in the concrete container concentrically;

disposing baffle bodies for braking gushes of refrigerated liquid attached vertically at the walls of the containers and protruding into the interspace between the containers, wherein the exposed angle between the tank and the baffle bodies is 90 degrees or greater, and wherein the baffle bodies extend in radial direction to from about one quarter to one half of the width of the annular interspace between the two containers.

19. The method for insuring the stability of containers according to claim 18 wherein the baffle bodies protrude from about 0.25 to 0.5 of the width of the interspace in radial direction.

* * * * *